US006705906B2

(12) United States Patent
Matsuda et al.

(10) Patent No.: US 6,705,906 B2
(45) Date of Patent: Mar. 16, 2004

(54) PERSONAL WATERCRAFT

(75) Inventors: Yoshimoto Matsuda, Kobe (JP); Toshio Araki, Kakogawa (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/177,504

(22) Filed: Jun. 19, 2002

(65) Prior Publication Data

US 2003/0008571 A1 Jan. 9, 2003

(30) Foreign Application Priority Data

Jun. 20, 2001 (JP) ..... 2001-186128

(51) Int. Cl.[7] ..... B63H 11/00
(52) U.S. Cl. ..... 440/38; 114/55.5; 440/88 A
(58) Field of Search ..... 440/88 A, 88 HE, 440/38; 123/572; 114/55.5

(56) References Cited

U.S. PATENT DOCUMENTS 6,478,002 B1 * 11/2002 Mashiko ..... 123/184.42

* cited by examiner

*Primary Examiner*—Jesus D. Sotelo
(74) *Attorney, Agent, or Firm*—Kolisch Hartwell P.C.

(57) ABSTRACT

Disclosed is a personal watercraft which is equipped with an engine designed in such a way that, even when the engine is splashed with water, its ignition plugs will not get wet and the heat generated from the engine or exhaust pipe will not act on, e.g., a riding seat. The personal watercraft includes a multi-cylinder engine having a crankshaft extending along its longitudinal direction and a water jet pump driven by the engine. The water jet pump pressurizes and accelerates water, and ejects the water from an outlet port opened rearward. The watercraft is propelled as a reaction of the ejecting water. An air filter box is so disposed as to overlie a cylinder head of the engine, thereby covering substantially at least the ignition plugs attached to the cylinder head.

9 Claims, 5 Drawing Sheets

PERSONAL WATERCRAFT

BACKGROUND OF THE INVENTION

1. Field of the Invention

The present invention relates to a personal watercraft (PWC) which ejects water rearward and planes on a water surface as the resulting reaction. More particularly, the present invention relates to an engine for the personal watercraft.

2. Description of the Related Art

In recent years, so-called jet-propulsion personal watercraft have been widely used in leisure, sport, rescue activities, and the like. The jet-propulsion watercraft is configured to have a water jet pump that pressurizes and accelerates water sucked from a water intake generally provided on a bottom of a hull and ejects it rearward from an outlet port. Thereby, the personal watercraft is propelled.

In the jet-propulsion watercraft, a steering nozzle provided behind the outlet port of the water jet pump is swung either to the right or to the left, to change the ejection direction of the water to the right or to the left, thereby turning the watercraft to the right or to the left.

Meanwhile, some jet-propulsion personal watercraft are provided with a riding seat disposed along its longitudinal direction. In such a watercraft, an engine is disposed in an engine room such that a crankshaft extends in the longitudinal direction of the watercraft. The crankshaft projects rearwardly and its rear end is coupled to a pump shaft of a water jet pump, thereby driving the water jet pump.

When such a personal watercraft is on the water and splashed with water, it sometimes becomes necessary to expose the engine by opening an engine room cover (a riding seat in some models) for inspection or repair work. In such cases, an ignition plug, mounted on the engine head, is likely to be splashed with water. Further, in some personal watercraft, the engine room is defined under the riding seat. In such a personal watercraft, heat from the engine or an exhaust pipe acts on the bottom of the seat and, as a result, the seat is heated.

SUMMARY OF THE INVENTION

The present invention addresses the above-described condition, and an object of the present invention is to provide a personal watercraft equipped with an engine designed in such a way that, even when the engine is splashed with water, its ignition plug is protected from water splashes, and heat generated from the engine or from an exhaust pipe attached thereto will not act on a riding seat.

As a solution to the aforementioned problem, a first aspect of the invention provides a jet-propulsion watercraft comprising: a water jet pump including an outlet port, the water jet pump pressurizing and accelerating water taken in from outside of the watercraft and ejecting the water from the outlet port to propel the watercraft as a reaction of the ejecting water; a multi-cylinder engine having a crankshaft extending along the longitudinal direction of the watercraft; and an air box so disposed as to overlie a cylinder head of the engine and to cover substantially at least ignition plugs attached to the cylinder head.

In the personal watercraft so constituted, the air box overlies and covers the ignition plugs. In such an arrangement, even when water splashes toward the ignition plugs, such water splashes are blocked by the air box, thereby protecting the ignition plugs from water splashes.

Further, since it is possible to extend the length of an intake pipe connecting the air box and an intake port of the engine, good inertia effects for air-intake are produced.

It is preferable that the engine of the above-described personal watercraft is a fuel injection-type engine. This results in an increase in intake pipe length as described above, and therefore provides enhanced intake inertia effects and engine power.

Also, it is preferable that the air box of the personal watercraft contain a throttle valve. With this structure, the effective length, which contributes to the intake inertia effects, can be further increased and mechanism parts of the valve are covered by the air box, thereby rendering the valve portion rustproof.

Further, it is preferable that the air box of the personal watercraft is so disposed as to overlie the cylinder head and to cover substantially the entire cylinder head. This constitution is capable of effectively preventing water splashes to the cylinder head and effectively preventing engine-radiated heat from transferring to the seat.

It is preferable that, in the personal watercraft, the air box is disposed over the cylinder head so as to deviate from the cylinder head toward an exhaust pipe disposed on an opposite side of an intake port of the engine with respect to the crankshaft and so as not to overlie the intake port and its vicinity. This facilitates the inspection of the components placed on the intake port side.

It is preferable that, in the personal watercraft, the air box has a through-hole vertically defined in the air box in such a way that the through-hole coincides with a position of the ignition plug in plan view. This facilitates the replacement and inspection of the ignition plug.

It is preferable that, in the personal watercraft, the through-hole is closed by a removable cap member provided on the top end of the through-hole. This facilitates the replacement and inspection of the ignition plug and enables the ignition plug to be protected against water splashes.

A second aspect of the invention provides a personal watercraft comprising a water jet pump including an outlet port, the water jet pump pressurizing and accelerating water taken in from outside of the watercraft and ejecting the water from the outlet port to propel the watercraft as a reaction of the ejecting water; a multi-cylinder engine having a crankshaft extending along the longitudinal direction of the watercraft; and a plurality of intake pipes so disposed as to traverse over a cylinder head of the engine.

In the personal watercraft so constituted, the intake pipes of relatively low temperature are located above the engine. Therefore, heat radiated from the engine is less likely to transfer upward. Further, in contrast to the personal watercraft of the first aspect of the invention, the personal watercraft of the second aspect can have a longer intake pipe length, thereby making it possible to provide greater intake inertia effects.

It is preferable that the air box of the personal watercraft is disposed on one side of the engine and connected to tip ends of the plurality of intake pipes and an exhaust pipe of the engine is disposed below the air box. Thereby, the heat from the exhaust pipe, which is going to transfer upward, is blocked by the air box. This therefore provides a constitution which is less affected by the heat from the engine, even when the riding seat is disposed above the engine room.

It is preferable that, in the personal watercraft, each of the intake pipes is arranged so as not to overlie an ignition plug provided on the cylinder head so that the ignition plug is accessible from above. This facilitates the inspection and replacement of the ignition plug.

It is preferable that, in the personal watercraft, the one side of the engine is an opposite side of the intake port with respect to the crankshaft. This makes it possible to extend the length of the intake pipe.

The above and further objects and features of the invention will more fully be apparent from the following detailed description with accompanying drawings.

DETAILED DESCRIPTION OF THE PREFERRED EMBODIMENTS

Hereinafter, a jet-propulsion watercraft according to embodiments of the present invention will be described with reference to the accompanying drawings.

Figure 4:
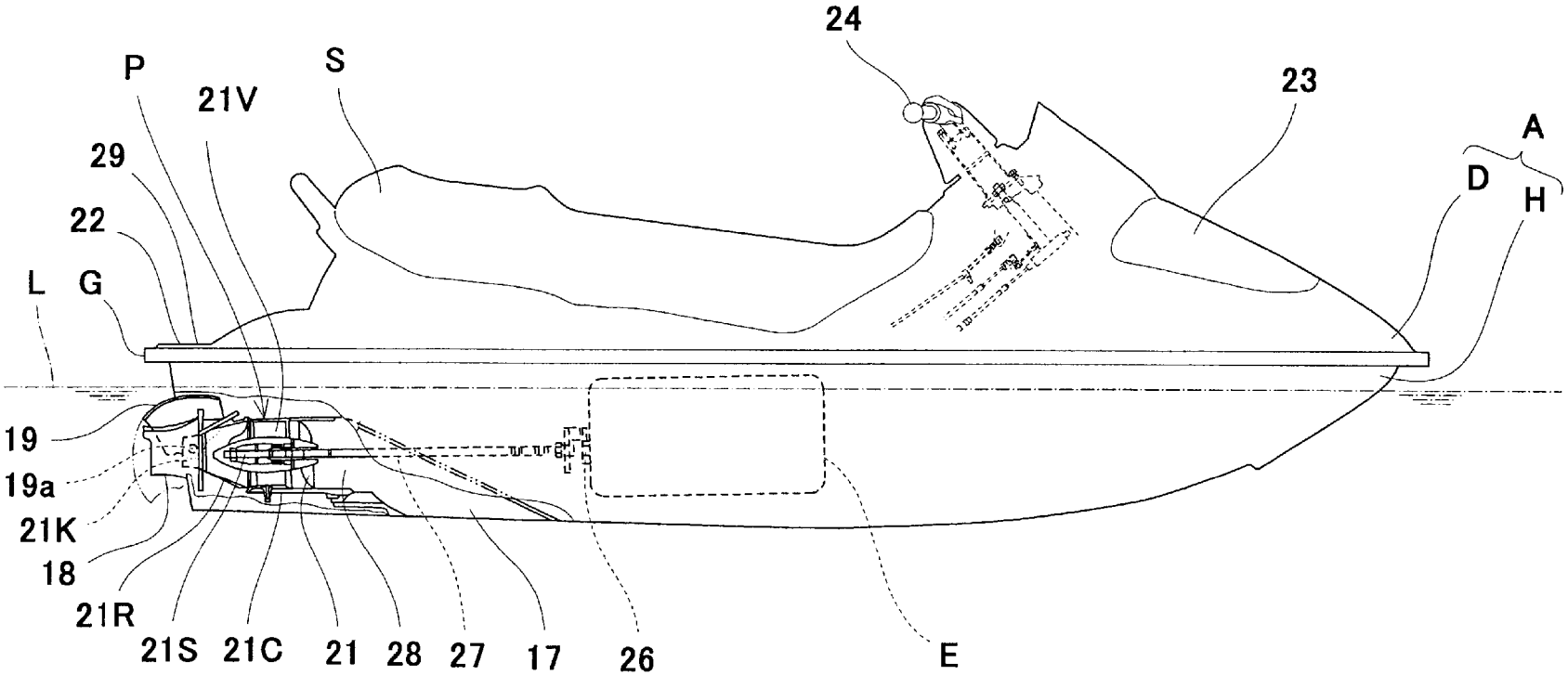
FIG. 4 is a side view showing an entire jet-propulsion personal watercraft according to the embodiments of the present invention.
Figure 5:
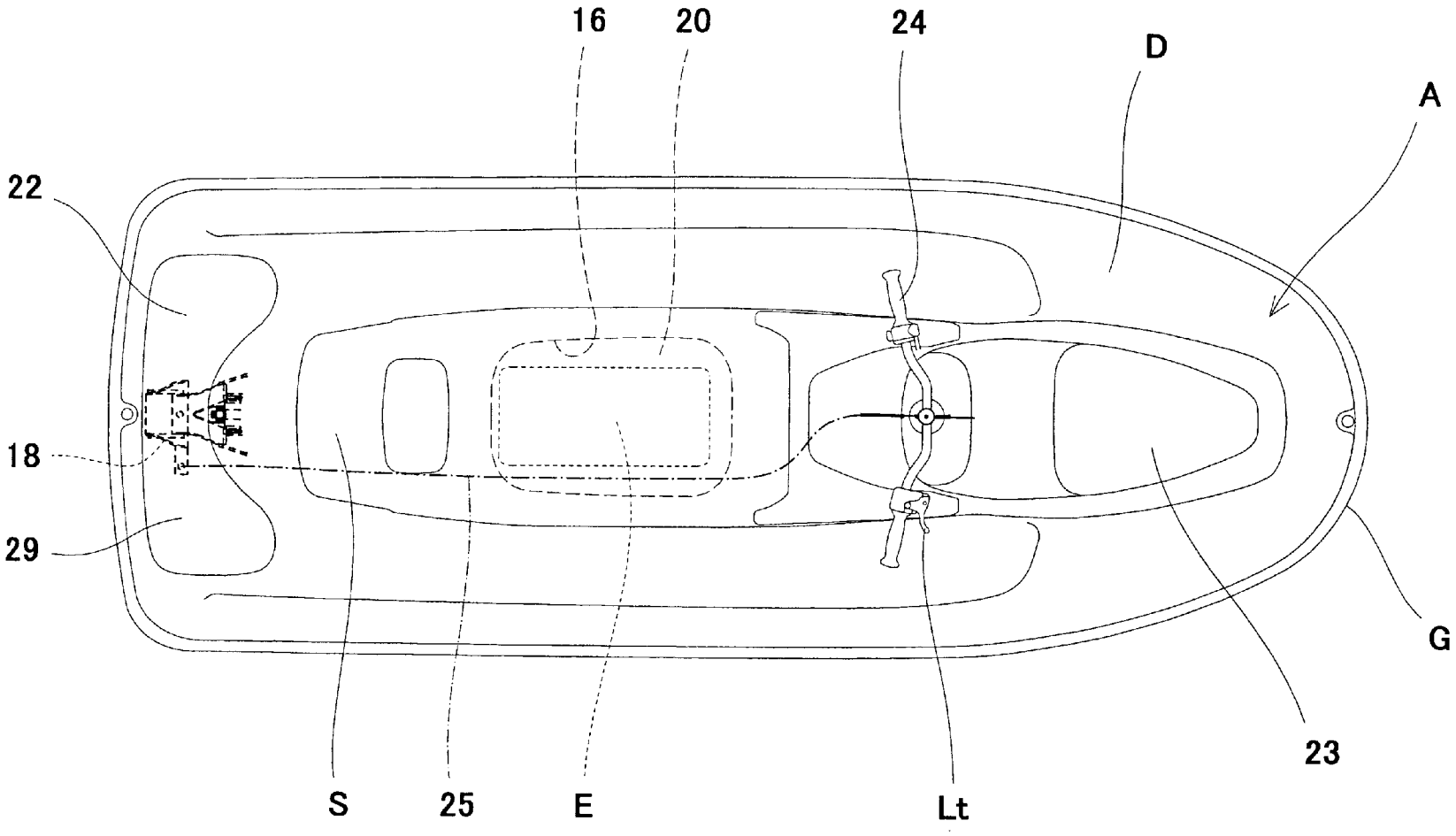
FIG. 5 is a plan view showing the entire personal watercraft of FIG. 4.

Referring now to FIGS. 4, 5, reference numeral A denotes a body of the personal watercraft. The body A comprises a hull H and a deck D covering the hull H from above. A line at which the hull H and the deck D are connected over the entire perimeter thereof is called a gunnel line G. In this embodiment, the gunnel line G is located above a waterline L of the personal watercraft.

As shown in FIG. 5, an opening 16, which has a substantially rectangular shape seen from above, is formed at a relatively rear section of the deck D such that it extends in the longitudinal direction of the body A, and a riding seat S is provided above the opening 16 such that it covers the opening 16 from above as shown in FIGS. 4, 5.

An engine E is provided in a chamber 20 surrounded by the hull H and the deck D below the seat S. The engine E includes multiple cylinders (e.g., four-cylinders) and is of a fuel injection type. As shown in FIG. 4, a crankshaft 26 of the engine E is mounted along the longitudinal direction of the body A. An output end of the crankshaft 26 is rotatably coupled integrally with a pump shaft of a water jet pump P through a propeller shaft 27. An impeller 21 is mounted on the pump shaft of the water jet pump P. The impeller 21 is covered with a pump casing 21C on the outer periphery thereof. A water intake 17 is provided on the bottom of the hull H. The water is sucked from the water intake 17 and fed to the water jet pump P through a water intake passage 28. The water jet pump P pressurizes and accelerates the water. The pressurized and accelerated water is discharged through a pump nozzle 21R having a cross-sectional area of flow gradually reduced rearward, and from an outlet port 21K provided on the rear end of the pump nozzle 21R, thereby obtaining a propulsion force.

In FIG. 4, reference numeral 21V denotes fairing vanes for fairing water flow behind the impeller 21. As shown in FIGS. 4, 5, reference numeral 24 denotes a bar-type steering handle as a steering operation means. The handle 24 is operated through a wire cable 25 to the right or to the left in association with the steering nozzle 18 provided behind the pump nozzle 21R such that the steering nozzle 18 is swingable to the right or to the left. The watercraft can be turned to any desired direction while the water jet pump P is generating the propulsion force. A throttle lever Lt is mounted on the right end portion of the handle 24.

As shown in FIG. 4, a bowl-shaped reverse deflector 19 is provided above the rear side of the steering nozzle 18 such that it can swing downward around a horizontally mounted swinging shaft 19*a*. The deflector 19 is swung downward toward a lower position behind the steering nozzle 18 to deflect the water ejected from the steering nozzle 18 forward and, as the resulting reaction, the personal watercraft moves rearward.

In FIGS. 4, 5, reference numeral 22 denotes a rear deck. The rear deck 22 is provided with an openable hatch cover 29. A rear compartment (not shown) with a small capacity is provided under the hatch cover 29. Reference numeral 23 denotes a front hatch cover. A front compartment (not shown) is provided under the front hatch cover 23 for storing equipment and the like.

In the watercraft according to the embodiments, as seen in FIGS. 1A, 1B, 2A, 2B, a cylinder head Ch is provided on the top end of the engine E and under the seat S. The cylinder head Ch has four intake ports Pi for introducing air into the engine and four exhaust ports Ep for discharging the exhaust gas. An exhaust pipe Pe is connected to the exhaust ports Ep. The exhaust ports Ep and the exhaust pipe Pe are arranged on an opposite side of the intake ports Pi with respect to the crankshaft 26. Four ignition plugs Fp are vertically provided on the cylinder head Ch.

Figure 1A:
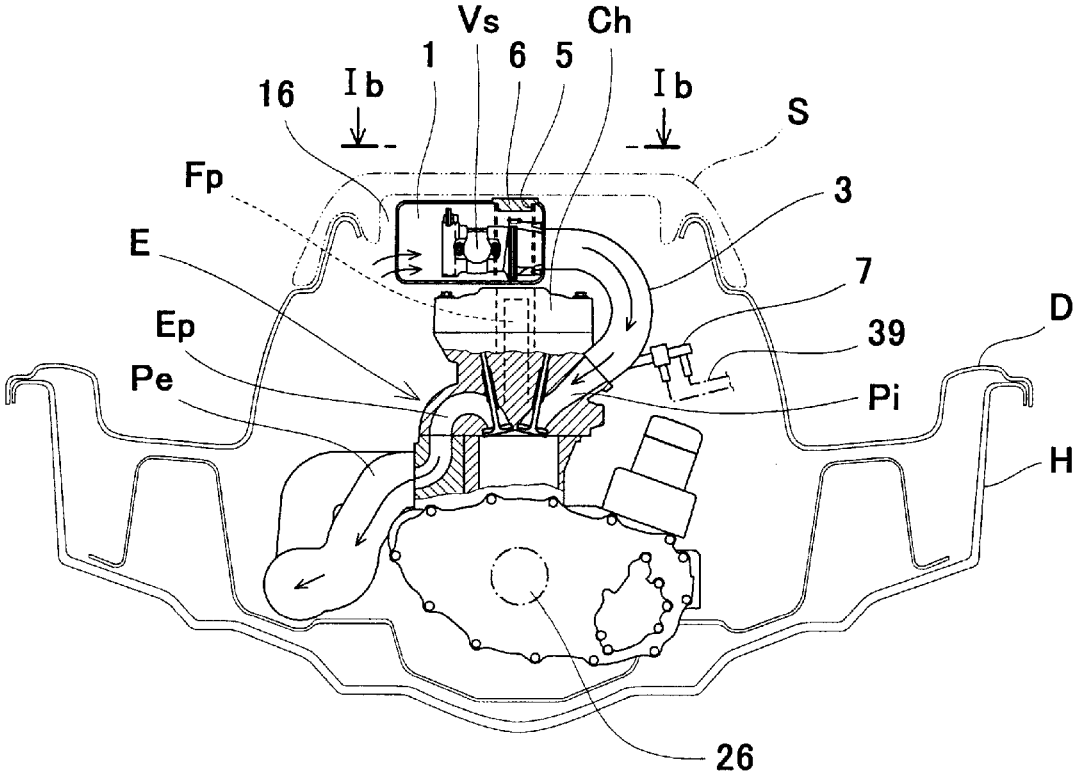
FIG. 1A illustrates major components of a first embodiment of a personal watercraft of the present invention and is a partially sectional view showing a constitution in which an engine of the personal watercraft and an air filter box overlying the engine are disposed.
Figure 1B:
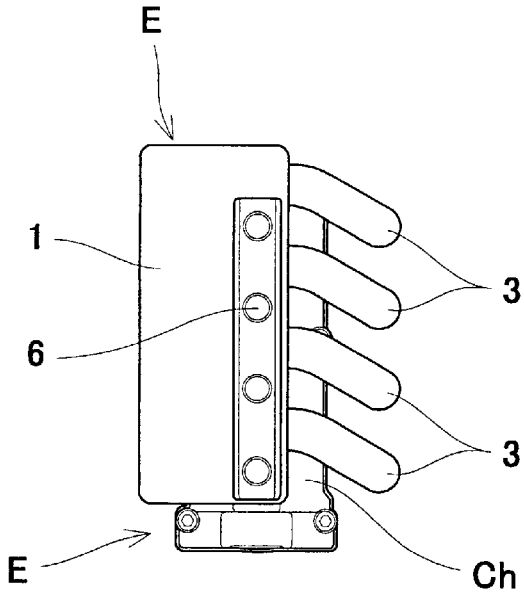
FIG. 1B illustrates major components of the first embodiment of the personal watercraft of the present invention, and is a plan view taken in the direction indicated by arrows Ib and Ib of FIG. 1A and showing arrangement of the engine, the air filter box, and intake pipes.

In the personal watercraft according to the first embodiment, as seen in FIGS. 1A, 1B, an air filter box (air-intake box) 1, which is a type of air box, is so disposed as to overlie the engine E, thereby covering substantially the entire engine E including the ignition plugs Fp arranged on the cylinder head Ch of the engine E. More precisely, the air filter box 1 deviates from the cylinder head Ch toward the exhaust pipe Pe and toward the rear of the watercraft. The air box 1 does not overlie the intake ports Pi of the engine E. That is, the intake ports side end of the air box 1 deviates from the intake ports Pi toward the exhaust ports Ep.

Also, four intake pipes 3 are configured such that their tip ends are in close contact with corresponding openings 1A of the air filter box 1 (see FIG. 3), and their base ends are respectively extended and connected to four intake ports Pi formed in the cylinder head Ch of the engine E and fixed to the cylinder head Ch. A filter 9 is provided inside of the air filter box 1 so as to be opposite to the opening 3A (see FIG. 3). Such arrangement allows clean air to be supplied from the air filter box 1 to each intake port Pi of the cylinder head Ch.

Figure 3:
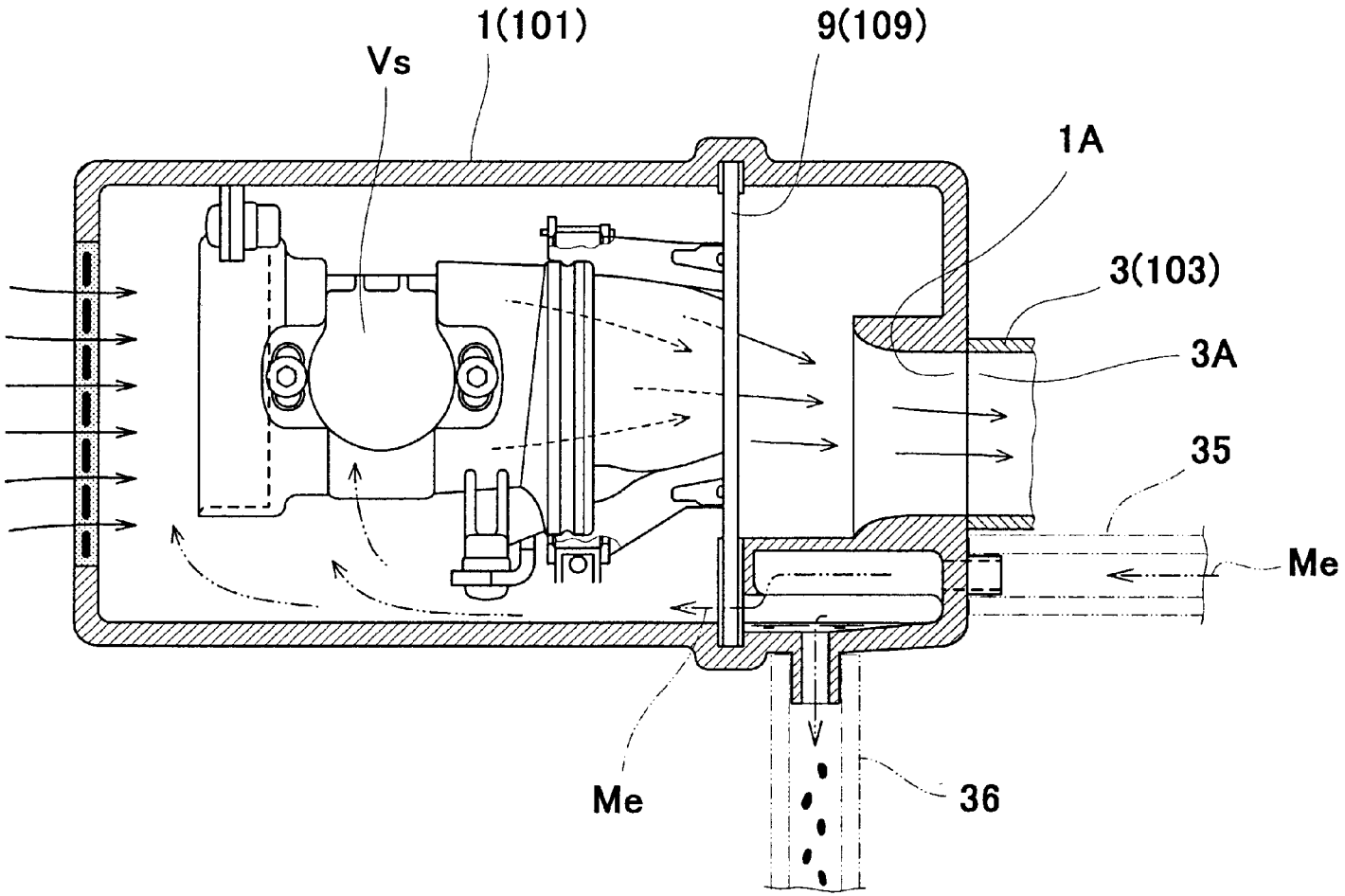
FIG. 3 is an enlarged cross-sectional view showing in detail the air filter box shown in FIGS. 1A, 1B, 2A, 2B.

Further, as shown in FIG. 3, a throttle valve Vs is provided in the air filter box 1 so as to be located on the opposite side of each intake pipe's 3 connecting portion or the opening 3A with respect to the filter 9. The throttle valve Vs serves to change air flow volume in each intake port Pi by changing the throttle position thereof. The throttle valve Vs is connected, through a control cable (wire), to a throttle lever Lt provided in the vicinity of a right grip of the handle 24 (FIG. 5).

As shown in FIGS. 1A and 1B, four through-holes 5 are vertically defined in the air filter box 1 disposed over the cylinder head Ch in such a way that these through-holes 5 coincide with the positions of the ignition plugs Fp as seen in plan view. Cap members 6 for closing the through holes 5 are removably attached to top ends of the through holes 5. The ignition plugs Fb can be easily attached/detached by removing the cap members 6 without removing the air filter box 1.

Further, each intake pipe 3 is provided with a fuel injection nozzle 7, at its base end (i.e., the end on the side of the intake port Pi). The fuel injection nozzle 7 is connected to a fuel tank through a supply pipe 39. Fuel is supplied from the fuel tank to each fuel injection nozzle 7 by using a fuel pump located in the supply pipe or in the fuel tank.

The personal watercraft of this embodiment having the aforementioned constitution functions as follows. When removing the seat S for inspection of the engine E or the like, the opening 16 is exposed upward. During this inspection, even when, for example, water splashes toward the opening 16 from above, the ignition plugs Fp will be protected against such water splashes, because the air filter box 1 overlies the cylinder head Ch of the engine E so as to substantially cover at least the ignition plugs Fp.

As in the embodiment shown in FIGS. 1A and 1B, the tip end of the intake pipe 3 is located in the air filter box 1 located apart from the intake port Pi and above the cylinder head Ch, thereby making it possible to extend the length of the intake pipe 3. This provides intake inertia effects.

In addition, the heat radiated from the engine E and transferred to the seat S is blocked by the air filter box 1 substantially covering the engine E.

Figure 2A:
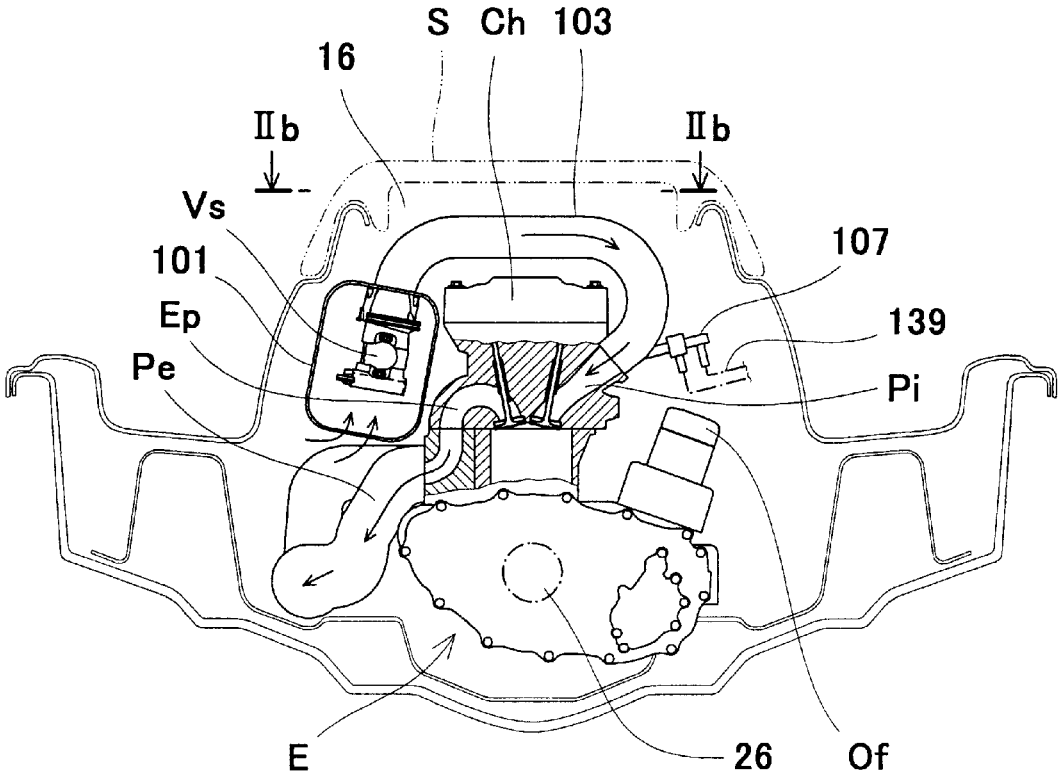
FIG. 2A illustrates major components of a second embodiment of the personal watercraft of the present invention that is different from the first embodiment (FIG. 1) and is a partially sectional view showing a constitution in which an engine of the personal watercraft and intake pipes traversing over the engine are disposed.
Figure 2B:
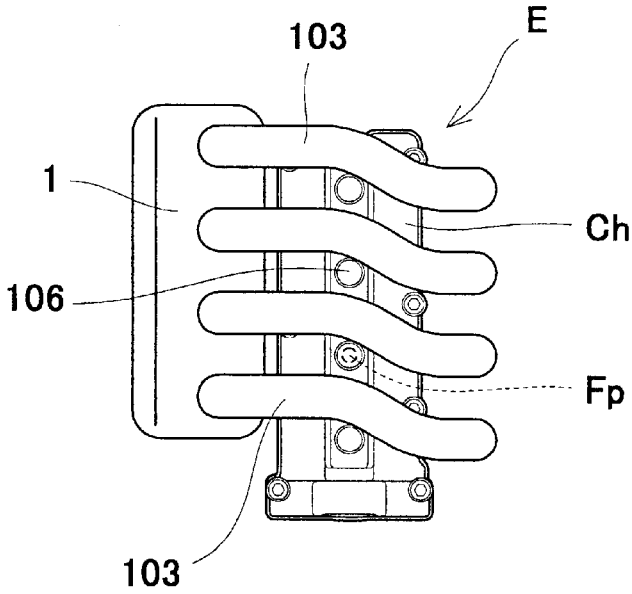
FIG. 2B illustrates major components of the second embodiment of the personal watercraft and is a plan view taken in the direction indicated by arrows IIb and IIb of FIG. 2A and showing arrangement of the engine, the air filter box, and the intake pipes.

Referring now to FIGS. 2A and 2B, a second embodiment of the present invention will be described.

In a personal watercraft according to this embodiment shown in FIGS. 2A and 2B, an air filter box 101 is so disposed as to overlie an exhaust pipe Pe of the engine E. Four intake pipes 103 are so arranged as to traverse above the cylinder head Ch of the engine E for establishing connections between the air filter box 101 and their corresponding intake ports Pi of the engine E. Also, in this embodiment, each intake pipe 103 is arranged so as not to pass above each ignition plug Fp as seen in plan view, thereby facilitating replacement of the ignition plug Fp from above. Furthermore, in this embodiment, circular disc-like cap members 106 integrally attached to an ignition cord (not shown) are disposed above the ignition plugs Fp so that the ignition plugs Fp can be protected against water splashes coming directly toward them.

In this embodiment, components identical with or corresponding to those in FIGS. 1A and 1B are identified by the same reference numerals or reference numerals with the addition of a numeral of 100.

According to the personal watercraft so constituted, the length of the intake pipes 103 can be extended further in comparison with the embodiment of FIGS. 1A and 1B. This makes it possible to provide a constitution suitable for the engine, because enhanced intake inertia effects are achieved.

Further, in this embodiment, since the air filter box 101 is disposed above the exhaust pipe Pe, the heat from the exhaust pipe Pe is blocked by the air filter box 101. As a result, the seat S disposed above will not be heated. Furthermore, since the intake pipes 103 of low temperature are disposed overlying the cylinder head Ch of the engine E, the degree of heat of the seat S disposed above the cylinder head Ch is reduced.

Moreover, according to the second embodiment, the air filter box 101 is not disposed on the side of the intake ports Pi of the engine E. Accordingly, components to be inspected relatively frequently (e.g., an oil gage, a filter for cooling passage of a muffler, or the like) or components requiring replacement (e.g., an oil filter Of, or the like) may be disposed on the intake port side. This offers easy inspection and maintenance.

In the embodiments, as shown in FIG. 3, the throttle valve Vs having movable mechanism elements is accommodated in the air filter box (1, 101) so that the movable mechanism elements of the throttle valve Vs is protected against water splashes or the like. Further, a part of the fuel containing oil is blown back toward the throttle valve Vs located in the air filter box (1, 101) from inside of the intake pipes (3, 103) so as to supply the oil to the movable mechanism elements of the throttle valve Vs in the closed space of the air filter box (1, 101). For the above-described reasons, high rust-proof effects for the throttle valve are obtained. In the embodiment, as shown in FIG. 3, blowby gas containing an oil mist Me produced in a crankcase (not shown) of the engine E may be positively introduced from a breather chamber of the crankcase into the air filter box (1, 101) through a hose 35 or the like, and a part of the oil mist Me may be led to the space in which the throttle valve Vs is accommodated, thereby achieving further enhanced rust-proof effects. In that case, it is preferred that liquefied oil separated from the blowby gas be returned toward an oil reservoir of the engine E through another hose 36 or the like.

Numerous modifications and alternative embodiments of the invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

What is claimed is:

1. A personal watercraft comprising:

a water jet pump including an outlet port, the water jet pump pressurizing and accelerating water taken in from outside of the watercraft and ejecting the water from the outlet port to propel the watercraft as a reaction of the ejecting water;

a multi-cylinder engine having a crankshaft extending along the longitudinal direction of the watercraft; and an air box so disposed as to overlie a cylinder head of the engine and to cover substantially at least ignition plugs attached to the cylinder head;

wherein the air box is disposed over the cylinder head so as to deviate from the cylinder head toward an exhaust pipe disposed on an opposite side of an intake port of the engine with respect to the crankshaft and so as not to overlie the intake port and its vicinity.

2. A personal watercraft comprising:

a water jet pump including an outlet port the water let pump pressurizing and accelerating water taken in from outside of the watercraft and ejecting the water from the outlet port to propel the watercraft as a reaction of the ejecting water;

a multi-cylinder engine having a crankshaft extending along the longitudinal direction of the watercraft; and an air box so disposed as to overlie a cylinder head of the engine and to cover substantially at least ignition plugs attached to the cylinder head;

wherein the air box has a through-hole vertically defined in the air box in such a way that the through-hole coincides with a position of the ignition plug in plan view.

3. The personal watercraft according to claim 2, wherein the through hole is closed by a removable cap member provided on the top end of the through-hole.

4. The personal watercraft according to claim 2, wherein the engine is a fuel injection-type engine.

5. The personal watercraft according to claim 2, wherein the air box contains a throttle valve.

6. A personal watercraft comprising:

a water jet pump including an outlet port, the water jet pump pressurizing and accelerating water taken in from outside of the watercraft and ejecting the water from the outlet port to propel the watercraft as a reaction of the ejecting water;

a multi-cylinder engine having a crankshaft extending along the longitudinal direction of the watercraft, and a plurality of intake pipes so disposed as to traverse over a cylinder head of the engine.

7. The personal watercraft according to claim 6, wherein an air box is disposed on one side of the engine and connected to tip ends of the plurality of intake pipes, and wherein an exhaust pipe of the engine is disposed below the air box.

8. The personal watercraft according to claim 7, wherein the one side of the engine is an opposite side of the intake port with respect to the crankshaft.

9. The personal watercraft according to claim 6, wherein each of the intake pipes is arranged so as not to overlie an ignition plug provided on the cylinder head so that the ignition plug is accessible from above.

* * * * *